US005765459A

United States Patent [19]

Hillebrand

[11] Patent Number: 5,765,459

[45] Date of Patent: Jun. 16, 1998

[54] METHOD FOR MOVING POINT NEEEDLES IN A TWO STAGE EXTENSION PATH

[75] Inventor: Bernd Anton Hillebrand, Bergrheinfeld, Germany

[73] Assignee: Koenig & Bauer-Albert Aktiengesellschaft, Wurzburg, Germany

[21] Appl. No.: 621,462

[22] Filed: Mar. 25, 1996

[30] Foreign Application Priority Data

Mar. 25, 1995 [DE] Germany ..... 195 11 052.8
May 19, 1995 [DE] Germany ..... 195 18 430.0

[51] Int. Cl.[6] ..... B65H 9/00; B26D 1/01

[52] U.S. Cl. ..... 83/27; 101/410; 270/42; 271/277; 271/3.24; 493/429; 493/432; 83/115; 83/154; 83/423; 83/436.1

[58] Field of Search ..... 83/154, 115, 346, 83/423, 27, 436.1, 410.7, 410.8, 409; 101/411, 410, 409; 271/277, 3.24; 493/431, 432, 425, 426, 427, 428, 429; 270/42, 50

[56] References Cited

U.S. PATENT DOCUMENTS

| | | | |
|---|---|---|---|
| 100,367 | 3/1870 | Bullock | 83/154 |
| 1,177,933 | 4/1916 | Dausman | 101/411 X |
| 1,185,088 | 5/1916 | Goss et al. | 493/426 X |
| 1,578,436 | 3/1926 | Herb | 493/427 X |
| 1,717,257 | 6/1929 | Rasmussen | 493/428 X |
| 1,784,757 | 12/1930 | Scott | 493/427 X |
| 1,816,947 | 8/1931 | Wise Wood | 493/431 |
| 1,829,243 | 10/1931 | Smith | 493/431 X |
| 1,831,220 | 11/1931 | Wood | 493/427 |
| 1,868,125 | 7/1932 | Tomlin | 83/167 |
| 2,031,780 | 2/1936 | Lamatsch | 493/360 |
| 2,318,953 | 5/1943 | Meyer | 83/154 X |
| 2,555,267 | 5/1951 | Crafts | 493/429 X |
| 3,593,606 | 7/1971 | Raybuck | 83/154 |
| 3,606,308 | 9/1971 | Mowry et al. | 271/277 |
| 3,758,102 | 9/1973 | Munn et al. | 493/432 X |
| 4,190,242 | 2/1980 | Bolza-Schunemann et al. | 270/50 |
| 4,290,595 | 9/1981 | Thunker | 271/277 |
| 4,368,879 | 1/1983 | Hoshi | 493/432 X |
| 4,437,855 | 3/1984 | Bullen | 493/427 X |
| 4,496,338 | 1/1985 | Michalik | 493/367 |
| 4,892,036 | 1/1990 | Lange | 101/240 |
| 4,909,150 | 3/1990 | Leyendecker et al. | 271/277 X |
| 5,427,005 | 6/1995 | Breton | 83/154 |
| 5,503,071 | 4/1996 | Hillebrand et al. | 101/411 X |

FOREIGN PATENT DOCUMENTS

| | | |
|---|---|---|
| 167861 | 1/1986 | European Pat. Off. . |
| 138 846 | 2/1903 | Germany . |
| 536459 | 10/1931 | Germany . |
| 1074057 | 1/1960 | Germany . |
| 3226119 | 4/1983 | Germany . |
| 38 10 439 | 8/1989 | Germany . |

*Primary Examiner*—Maurina T. Rachuba
*Attorney, Agent, or Firm*—Jones, Tuller and Cooper, P.C.

[57] ABSTRACT

Point needles in a collecting cylinder are driven in a two stage extension process to initially needle or pierce the leading edge of a product web being cut. Once the cut has been made, the needle tips are moved further radially outwardly from the cylinder to secure the cut edge. As the signatures are transferred to a folding cylinder, the needle points are retracted along a single stage retraction curve which is different from the path traveled during the two stage extension process.

2 Claims, 2 Drawing Sheets

METHOD FOR MOVING POINT NEEEDLES IN A TWO STAGE EXTENSION PATH

FIELD OF THE INVENTION

The present invention is directed generally to a method and apparatus for moving point needles. More particularly, the present invention is directed to a method and apparatus for moving paint needles in a conveying cylinder. Most specifically, the present invention is directed to a method and apparatus for moving point needles in a conveying cylinder of a rotary printing press. The point needles pierce the edge of a web-shaped product prior to its being cut into signatures by a cutter. These point needles are arranged in point needles holders which are supported by movable, controllable point holder arms. The point needles are caused to extend out beyond the periphery of the conveying cylinder in a two stage process in which the directions of travel of the points of the needles are different during each of the two extension steps. The point needles are retracted back into the conveying cylinder in a single stage process along a single retraction curve.

DESCRIPTION OF THE PRIOR ART

In the production of various folded printed products in a rotary web-fed printing press, a continuous web of material to be printed, such as a paper web, is printed by passing through one or more printing couples. After the web has been printed, it may be associated with other printed webs and may then be longitudinally folded. The still continuous length web is then cut into discrete lengths by the operation of a cutting blade that cooperates with a collecting and folding blade cylinder. This collecting and folding blade cylinder is also provided with a plurality of gripping devices that engage the newly created leading edge of the web just upstream of the cutting point, and that hold the newly severed signatures on the periphery of the collecting and folding blade cylinder until these signatures are cross folded by the cooperation of a folding blade on the collection and folding blade cylinder with jaws on a folding jaw cylinder. While various types of gripping devices are known in the art, one gripping arrangement utilizes a plurality of points or needles that essentially pierce the leading edge of the product web and then hold the cut signature on the collecting and folding blade cylinder. These points or needles move in a generally radial direction with respect to the collecting and folding blade cylinder.

One folding apparatus which consists of a cutting cylinder; a point, collecting and folding blade cylinder; and a folding jaw cylinder is shown in German Patent Publication DE 38 10 439 C1. In this prior art device, the leading edge of a printed web is directed between the cutting cylinder and the point, collecting and folding blade cylinder, hereinafter the conveying cylinder. This web leading edge is needled or pierced by the plurality of points disposed on the conveying cylinder and is then cut by the cooperation of the cutting blade cylinder and the cutting bar situated on the periphery of the conveying cylinder. This cutting of the printed web is accomplished at a location just downstream, in the direction of web travel, from the points. The newly created cut web sections or signatures are conveyed by, or collected on, the conveying Cylinder and are subsequently transferred to the folding jaw cylinder. As the signatures are transferred to the folding jaw cylinder, the needles or points are retracted to release the signatures from the conveying cylinder. In this prior art device, the point tips, which are used to pierce or needle the product to a depth dependent on the thickness of the product being handled, are caused to project from the peripheral surface of the point, collecting and folding blade cylinder or conveying cylinder by the operation of a spindle carried in the conveying cylinder, and by a plurality of point holder arms which are attached to the spindle. These point holder arms are arranged across the width of the conveying cylinder in an axially extending line with each point holder arm typically supporting one or several axially spaced point needles. The spindle is caused to rotate by a cam drive having a cam surface which engages a roller or roller lever on the end of the spindle. In the operation of this prior art conveying cylinder, the point tips of the point needles move over a portion of a curvature path around the axis of rotation of the spindle which is fixed in place on the conveying cylinder.

A disadvantage of this prior art folding apparatus is a result of the generally curved path which the point needles are caused to travel. This travel path dictates that the point needles must be situated at a relatively great distance away from the cutting bar. When the cutting blade and the cutting bar engage each other to cut the leading edge of the printed web, it is clear that they must have an unobstructed path. Any collision between the cutting edge of the cutting blade and a web gripping device, such as a point needle, will severely damage both the point needle and the cutting edge. In addition, the paper web will not be properly cut and the resultant signature will have a rough, torn edge instead of a smooth, cut edge. The point needles must therefore be spaced from the cutting bar at a distance sufficient to insure chat they will not interfere with the operation of the cutting blade. When the point needles are located at a relatively large distance from the cutting bar, the result is a significant space between the cut edge of the signatures and the line of perforations formed by the point needles. This requires that the cut and folded signatures undergo an additional edge trimming or cutting step particularly in the instance of job or telephone directory printing. This additional cutting or trimming step severs the edge strip with the point holes from the product and must be done after the printing and folding has been accomplished. The requirement for this additional edge trimming step generates large amounts of waste or scrap paper and adds an additional step to the production process.

It will be seen that a need exists for a gripping device and its method of operation which overcomes these limitations of the prior art. The method and apparatus for moving point needles in accordance with the present invention provides such a method and apparatus and is a significant improvement over the prior art.

SUMMARY OF THE INVENTION

It is an object of the present invention to provide a method and apparatus for moving point needles.

Another object of the present invention is to provide a method and apparatus for moving point needles in a conveying cylinder.

A further object of the present invention is to provide a method and apparatus for moving point needles in a conveying cylinder of a rotary printing press.

Still another object of the present invention is to provide a method and apparatus for moving point needles at the periphery of the conveying cylinder.

Yet a further object of the present invention is to provide a method and apparatus for moving point needles in which the needles penetrate the product web close to the cutting line of a cutting blade acting against the cutter bar.

As will be discussed in detail in the description of the preferred embodiment which is presented subsequently, the point needles are insertable into a leading edge of a product web just before or upstream of the point of cooperation between a cutting blade and a cutting bar which is part of the conveying cylinder that also includes the point needles. These point needles are arranged in point needle holders which are carried at the free ends of point holder arms. Each point needle holder performs a generally arcuate pivot movement so that the point needle tips will be moved from a base position inside of the periphery of the conveying cylinder to a center position outside of the periphery of the conveying cylinder. As the point needle tips travel from their base position to their center position along an extension curve, they pierce or needle the leading edge of the product web. The point needle tips are then moved further outwardly to an end position in a second, generally radial direction. With the point needle tips in their center position, the cutting of the web can be accomplished by the operation of the cutting blade. After the web has been cut, or as the web is being cut, the needles move to their end position. After the signatures have been cut and conveyed by the conveying cylinder, the point needle tips will be retracted back below the periphery of the conveying cylinder; i.e. they will be retracted from their end position to their base position in a single arcuate path along a retraction curve which is different from the extension curve.

A particular advantage of the method and apparatus for moving point needles in accordance with the present invention is that a shorter or smaller distance exists between the point holes and the cut edge of the printed product than was possible in the prior art devices. This is due to the two part or two step extension path which the point needle tips follow as they move from their inner, base position to their fully extended end position. This two step path allows the point needle tips to be inserted into the printed product web much closer to the cutting blade without hampering the cutting process. This is of particular advantage in connection with the printing of telephone directories and with job printing since it is possible to cut off a much narrower edge strip in the course of subsequent processing of the cut and folded signatures. This greatly reduces the amount of paper waste.

Another advantage of the method and apparatus for moving point needles in accordance with the present invention is that in the course of the transfer of the signatures from the point, collecting and folding blade cylinder or conveying cylinder to the folding jaw cylinder the retraction of the point needle tips out of the signatures is made much easier. This movement of the point needle tips in the retraction direction with respect to the signature end which is still located on the surface of the conveying cylinder makes "un-needling" of the signatures, or retraction of the point needles, much easier. This reduces slitting of the point holes, damage to the needle points and pulling of the signatures out of the folding jaws of the folding jaw cylinder.

The method and apparatus for moving point needles in accordance with the present invention overcomes the limitations of the prior art. It is a substantial advance in the art.

BRIEF DESCRIPTION OF THE DRAWINGS

While the novel features of the method and apparatus for moving point needles in accordance with the present invention are set forth with particularity in the appended claims, a full and complete understanding of the invention may be had by referring to the detailed description of the preferred embodiment, as presented subsequently, and as illustrated in the accompanying drawings, in which:

DETAILED DESCRIPTION OF THE PREFERRED EMBODIMENT

Figure 1:
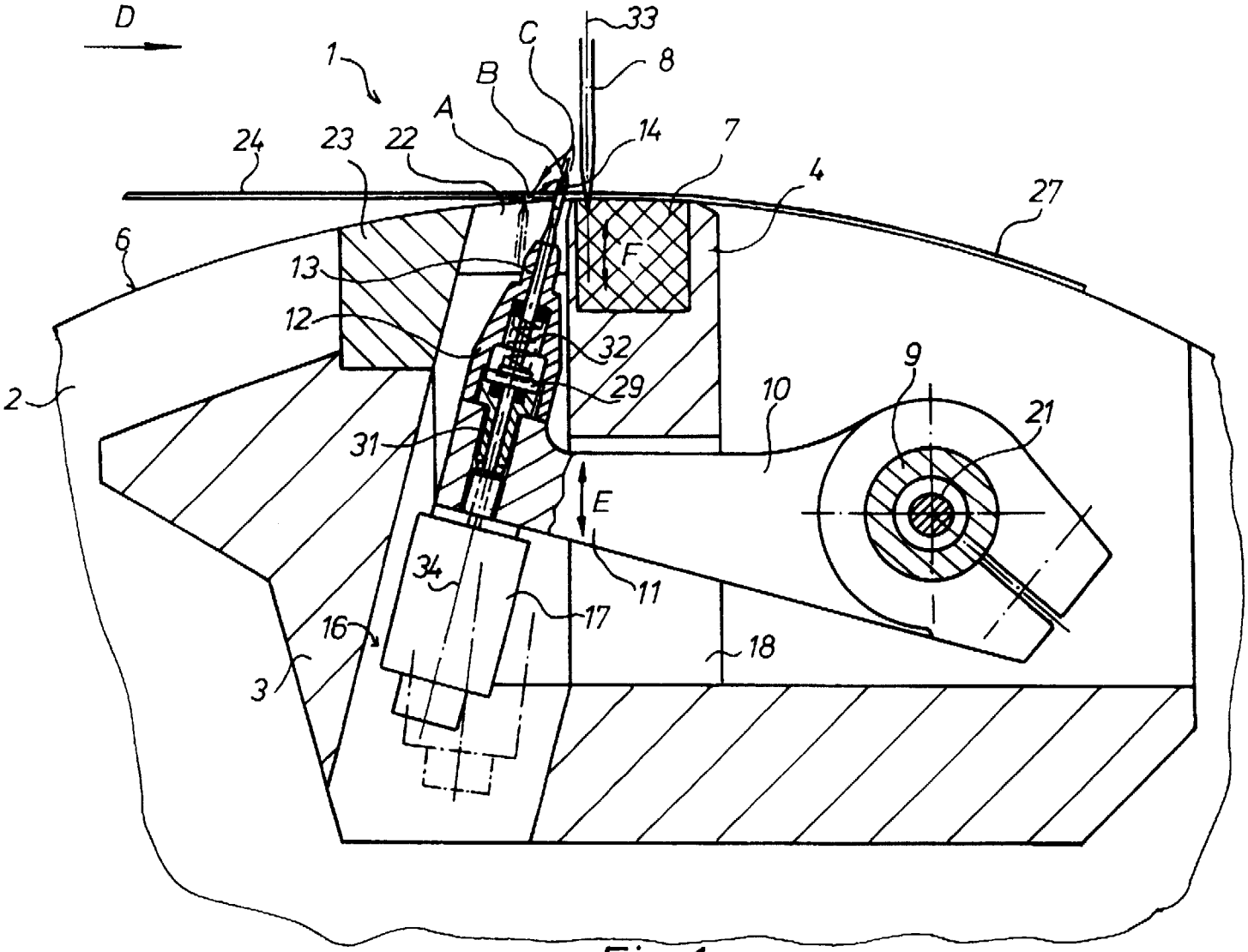
FIG. 1 is a schematic side-elevation view, partly in cross section and showing a portion of a conveying cylinder with the point drive in accordance with the present invention, and showing a cutting blade cooperating with a cutting bar of the conveying cylinder.

Referring initially to FIG. 1, there may be seen, generally at 1, a conveying cylinder which is usable in a web-fed, rotary printing press to receive a leading edge of a printed product or web, to cut the web into signatures, and to convey the cut signatures to a cooperating folding law cylinder. It will be understood that the printing press in which the conveying cylinder 1 is positioned, as well as the structure of the cutting blade cylinder and the folding jaw cylinder with which it cooperates are generally well known in the art and form no part of the present invention. Accordingly, they are not shown in the drawings or discussed in detail.

Again referring to FIG. 1, conveying cylinder 1 is a generally open cylinder whose structure is defined by spaced lateral disks 2, with only one such disk 2 being shown, which disks 2 are connected by several circumferentially spaced cross arms 3, only one of which is shown in FIG. 1. Conveying cylinder 1 is supported by suitable axle journals between spaced side frames of the press and is caused to be rotated by any suitable cylinder drive arrangement. Each of the cross arms 3 extends between the lateral disks 2 in a direction parallel to the axis of rotation of the conveying cylinder 1. Each of these cross arms 3 has a grooved bar 4 which receives an axially extending cutting bar 7. The cutting bar 7 is oriented toward a periphery 6 of the conveying cylinder 1. A cutting blade or cutter 8, that is carried by a cutting cylinder (not shown), is engageable with the cutting bar 7 to cut the leading end of a continuous web 24. The cooperation of the cutting bar 7 and the cutting blade 8 cuts the continuous web 24 and forms a plurality of signatures 27 which are held on the surface 6 of the conveying cylinder 1 and which are then cross folded by the operation of a folding blade on the conveying cylinder with folding jaws of a folding jaw cylinder.

In accordance with the present invention, the newly created leading end of the continuous web shaped product 24, as well as the leading edge of each cross-cut signature 27 is held on the periphery 6 of the conveying cylinder 1 by the operation of a pluralilty of point needles 14. As may be seen in FIG. 1, a point holder arm 10 for each point needle or group of point needles 14, is clamped in place on a rotatable control spindle 9 having an axis of rotation generally parallel to the axis of rotation of the conveying cylinder 1. The ends of the control spindle 9 are rotatably supported in the lateral disks 2 of the cylinder 1. A free end 11 of each point holder arm 10 supports a point needle holder 12. This point needle holder 12 has a radial outer end 13 which is close to the periphery 6 of the conveying cylinder 1. The point needle 14 is located at this radial outer end 13 of the point needle holder 12. It will be understood that a plurality of similar point needle holders 12 are carried by a plurality of similar point holder arms 10 which are all attached at their inner ends to the control spindle 9. These plural point needle holders 12 extend across the width of the conveying cylinder 1 generally in an axial direction. At its radial inner end 16, remote from the needle point 14, each point needle holder 12 is connected with a point needle drive 17 which, in the preferred embodiment may be a lifting magnet or solenoid.

In this arrangement, the point needle 14 is fixed in a point needle pusher 29 that has a point needle pusher guide 31 which is connected with the lifting magnet or solenoid 17. In a rest position, as is depicted in FIG. 1, the point needle pusher 29, and thus the point needle 14 are disposed in a rest position in which the pusher 29 is pushed against the point needle drive 17 by the force of a pressure spring 32.

The grooved bar 4, which is supported by the cross arm 3 and which is fastened to the lateral disks 2, has one hole or aperture 18 for each point holder arm 10. Depending on the production requirements of the conveying cylinder 1, there will be a plurality of these point holder arms 10, point needle holders 12 and point needles 14 disposed in an axially spaced apart manner across the width of the conveying cylinder 1 and secured to the control spindle 9. This control spindle 9 has at least one of its ends securely connected to a roller lever, which is not shown in the drawings, and which is frictionally or interlockingly connected to a control cam that is fixed on the lateral side frame. The control spindle 9 is configured as a hollow spindle and carries a torsion bar 21 in its interior. This torsion bar 21 has one end connected to the hollow spindle in a manner fixed against rotation and has the other end secured to the lateral disk 2. This insures that the roller lever or levers carried by the control spindle 9 are securely engaged against the control cam. As the conveying cylinder 1 is caused to rotate by any suitable drive arrangement, the engagement of the control spindle roller or rollers with the control cam will effect the movement of the various point needle holder arms 10 so that the various point needles 14 can emerge through a slit 22 which extends in the axial direction of the periphery 6 of the conveying cylinder 1. This slit can be made wider by the removal of a cover strip 23, as seen in FIG. 1.

Figure 2:
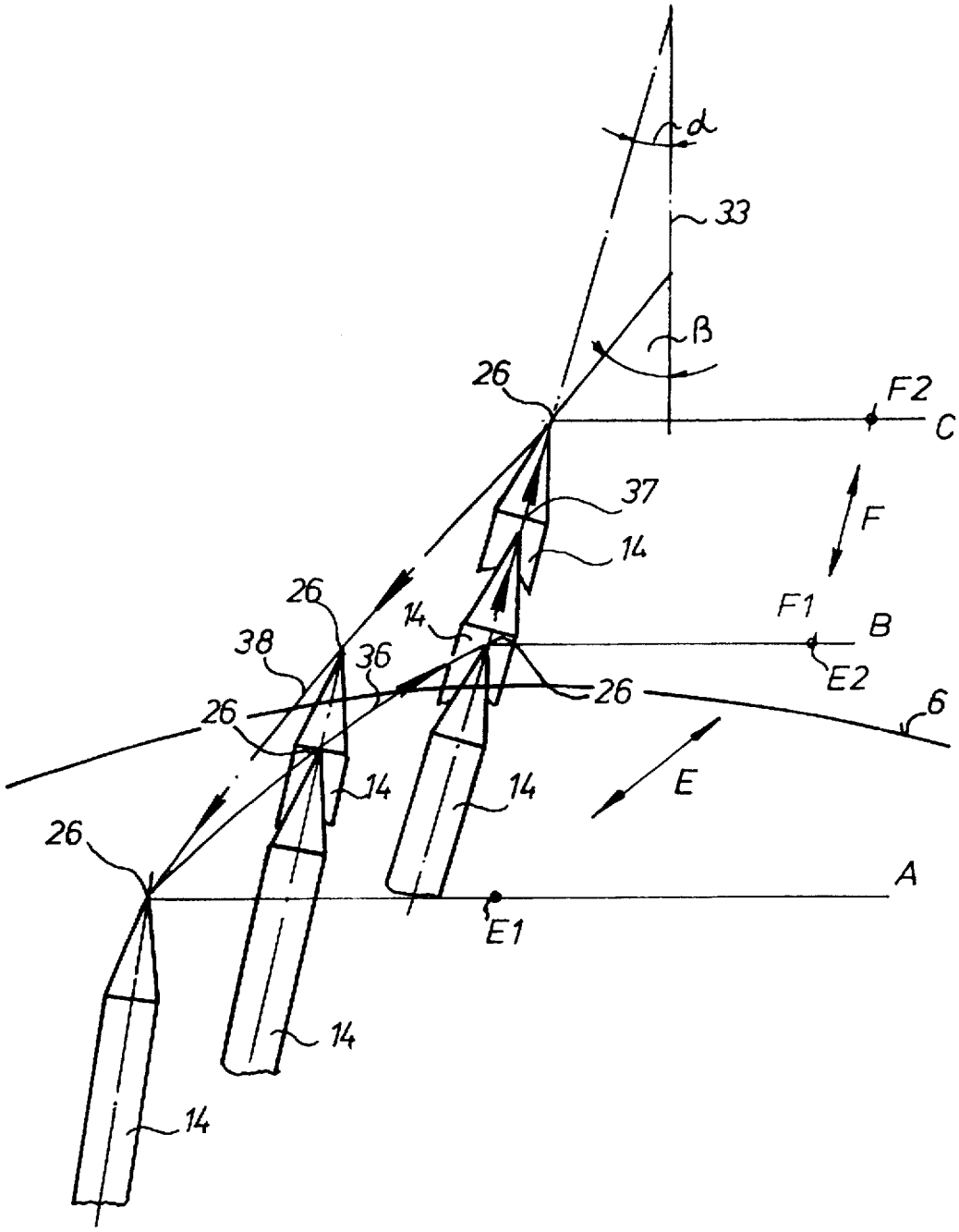
FIG. 2 is a schematic depiction of the extension and retraction paths traveled by a point needle tip in accordance with the point drive shown in FIG. 1.

In the course of operation of the web-fed press in which the subject device is used, a leading edge of a continuous product web 24 enters into a space between the cutting cylinder (not shown) and the conveying cylinder 1. This continuous web 24 is traveling in the production direction, as indicated by arrow D in FIG. 1. As the continuous web 24 contacts the periphery 6 of the conveying cylinder 1, its leading edge is pierced or needled by the plurality of axially arranged point needles 14. These point needles 14 have been elevated from their base position A, as seen in FIGS. 1 and 2 to their center position B along an extension curve portion 36 of a two step extension path. Once the continuous web 24 has been needled, it is then transversely cut by the cutter 8 acting against the cutting bar 7 of the conveying cylinder 1. Prior to accomplishing the needling or piercing of the continuous 24, the needle tips 26 perform a first movement from their base position A, as seen in FIG. 2, to their center position B along a rising needle, extension curve. As the needle tips 26 follow this extension curve 36, they pass upwardly through or beyond the periphery 6 of the conveying cylinder 1. This extension curve 36 is generated by the circular arc-shaped movement or the needle tips 26 from E1 to E2, again as seen in FIG. 2. The center position B of the needle tips 26 is in the immediate proximity of a generally radially extending line 33 which is generally vertical, as seen in FIG. 2. This line 33, at the time of the cutting of the continuous web 24, represents the center line of the cutter 8 which is carried by the cutting cylinder (not shown)and which engages the cutting bar 7 on the conveying cylinder 1.

Following the complete transverse cutting of the continuous web 24 by the cutter 8 and the start of the separating movement between the point needles 14 and the tip of the cutter 8, the needle tips 26 of the point needles 14 now perform a second, generally radially outwardly movement as the second part of their two part extension path out of the conveying cylinder 1. This second, radial outward movement of the needle tips 26 increase the point needle's grip on the continuous web 24 but does not bring the needle tips 26 into potentially dangerous contact with the cutter 8. The radial outer movement of the needle tips 26, generally in the direction indicated by arrow F in FIG. 2, from the location F1 to the location F2 brings the needle tips 26 to their radial end position C in which the needle tips 26 have traveled their greatest distance since leaving the periphery 6 of the conveying cylinder 1. Because of this generally radially outward linear movement of the needle tips 26 in the second stage of their outward travel from the center position B to the end portion C, there are only small additional forces exerted on the continuous web 24. This prevents any slitting or tearing of the holes or perforations formed on the continuous web 24 by the point needles 14. In this end position C, the point needles 14 hare been extended sufficiently so that following the cutting of the second separation cut through the continuous web 24, the now created signature 27 will be protected from any automatic "un-needling" on the conveying cylinder. Such an "un-needling" would act to release the signature 27 from the periphery 6 of the conveying cylinder 1.

Referring again primarily to FIG. 1, the radial outward travel of the point needles 14 from the center position B to the end position C takes place while the point holder arm 10 is essentially stopped. After the point needle holders 12 have been moved to the center position B by the rotation of the control spindle 9, the point needle pusher 29 is caused to move outwardly toward the periphery 6 of the conveying cylinder 1 by actuation of the point needle drive 17. This moves the needle tips 26 from the center position B to the end position C. This movement is generally radially outwardly with respect to the conveying cylinder 1. As is shown in FIG. 2, this movement direction of the needle tips 26 during the second stage of their outward movement is approximately at an angle $\alpha$ of 20° with respect to the radial or perpendicular line 33. This linear movement F of the needle tips 26 is accomplished by the magnetic actuation of the pusher guide 31 and extends in the direction of an axis of movement or a longitudinal axis 34 of the point needles 14.

The conveying cylinder 1 is provided with folding blades that are not specifically shown but which operate in a generally conventional manner to transfer each signature 27 to a folding jaw cylinder of the folding apparatus. Such a folding jaw cylinder is shown in the German Patent Publication DE 38 10 439 C1 discussed previously. Once the folding blade has formed the transverse fold in the signatures 27 and during the transfer of the ends of the signatures 27 still held on the periphery 6 of the conveying cylinder 1, the needle tips 26 of the point needles 14 will be returned from the extended end position C to the retracted base position A. This base position A is located within the periphery 6 of the conveying cylinder 1, as seen most clearly in FIG. 2. The retraction of the needle tips 26 from position C to position A is along a retraction curve 38 that extends from F2 to E1 without passing through the center position B. This retraction curve 38 is almost in the form of a straight line with a center angle $\beta$ of approximately 40° with respect to the radial or perpendicular line 33, as shown in FIG. 2. This retraction of the point needles 14 and their needle tips 26 releases the end of the now cross-folded signatures 27 from the periphery 6 of the conveying cylinder 1. In this retraction process, there is not only a return of the needle tips 26 underneath the periphery 6 of the conveying cylinder 1 because of the superposition of the movement E of the point holder arms 10 and of the movement F of the pusher 29 in the form of a partially spiral movement but at the same time a movement of the needle tips 26 in the retracting direction of the end of the already folded signature; i.e. in a direction opposite to the direction of rotation of the conveying cylinder 1. This retraction curve or retraction direction of travel of the needle points 14 is a single step movement as opposed to the two step extension operation. The circumferential speed of travel of the point needles 14 is reduced during the retraction. This assures a qualitatively correct transfer of the printed product from the conveying cylinder 1 to the next, associated cylinder.

The actuation of the point needle drive 17, which may be, for example, a lifting magnet or solenoid can take place by way of a current feed located exteriorly of the conveying cylinder 1. Suitable collector rings could be utilized to accomplish the actuation of the point needle drive 17.

In the preferred embodiment of the present invention, the travel distance of the needle tips 26, from their emergence from the periphery 6 of the conveying cylinder 1 cut to their maximum end position C is a distance of between 5 to 15 mm with 11 mm being preferred for thick products. This travel distance is measured in the radial direction of the conveying cylinder 1. A radial distance from the base position A to the center position B of the needle tips 26 corresponds to two-thirds of the total radial distance of travel of the needle tips 26 from the base position A to the maximum position C.

In the apparatus for moving point needles in accordance with the present invention, it would be possible to provide the point needle drive 17 as a reversing lifting magnet or double acting solenoid. This reversing lifting magnet drive has two switching positions so that the use of the pressure spring 32 for the automatic return of the pusher 29 can be done away with. It would also be possible to provide the point needle drive 17 as some other arbitrary linear drive such as, for example a pneumatic work cylinder with an air supply that is connected by the use of a rotary inlet at the axle journal to a suitable source of pressurized fluid.

While a preferred embodiment of a method and apparatus for moving point needles in accordance with the present invention has been set forth fully and completely hereinabove, it will be apparent to one of skill In the art that a number of changes in, for example, the overall size of the cylinder, the specific type of rotary printing press, the drive for the cylinder and the like could be made without departing from the true spirit and scope of the present invention which is accordingly to be limited only by the following claims.

What is claimed is:

1. A process for moving point needles in a conveying cylinder of a folding apparatus and for penetrating a continuous web with said point needles, said process including the steps of:

providing a conveying cylinder and supporting said conveying cylinder for rotation about an axis of rotation;

providing a plurality of movable point holder arms in said conveying cylinders;

attaching first ends of said movable point holder arms to said conveying cylinder for movement of said movable point holder arms with respect to said conveying cylinder axis of rotation;

arranging a plurality of point needles having point needle tips in point needle holders;

supporting said point needle holders at second ends of said movable point holder arms;

moving said movable point holder arms in said conveying cylinder;

moving each of said point needle holders in a circular, arc-shaped pivot movement by said moving of said movable point holder arms;

moving said point needle tips along an extension curve from a base position inside a periphery of said conveying cylinder to a center position outside of said periphery by said moving of said point needle holders;

needling said continuous web during said movement of said point needle tips along said extension curve to said center position;

cutting said continuous web subsequent to said needling of said continuous web; and extending said point needle tips in said point needle holders in a direction generally along a longitudinal axis of said point needles to extend said point needle tips to a maximum extended position of said point needle tips after said cutting of said continuous web.

2. The process in accordance with claim 1 further including retracting said point needle tips along a retraction curve from said extended position of said point needle tips and releasing said continuous web, said retraction curve being different from said extension curve.

* * * * *